US007571515B2

(12) United States Patent
Fischbach et al.

(10) Patent No.: US 7,571,515 B2
(45) Date of Patent: Aug. 11, 2009

(54) DRIVE SYSTEM FOR A DOOR OR WINDOW AND METHOD OF OPERATING SAME

(75) Inventors: Stefan Fischbach, Leonberg (DE); Matthias Hucker, Marxzell (DE); Guenter Andraschko, Murr (DE); Joachim Augenstein, Niefern-Oeschelbronn (DE)

(73) Assignee: GEZE GmbH, Leonberg (DE)

( * ) Notice: Subject to any disclaimer, the term of this patent is extended or adjusted under 35 U.S.C. 154(b) by 0 days.

(21) Appl. No.: 10/377,027

(22) Filed: Mar. 3, 2003

(65) Prior Publication Data

US 2003/0213092 A1 Nov. 20, 2003

(30) Foreign Application Priority Data

Mar. 1, 2002 (DE) ..... 102 09 268
Dec. 20, 2002 (DE) ..... 102 59 925

(51) Int. Cl.
*E05F 3/00* (2006.01)
*E05F 1/10* (2006.01)
*E05F 15/10* (2006.01)
*E05F 11/10* (2006.01)

(52) U.S. Cl. ..... 16/79; 16/69; 16/64; 49/32; 49/342

(58) Field of Classification Search ..... 16/79, 16/69, 64, 80, 65, DIG. 21; 49/32, 334, 340–342, 49/386, 324
See application file for complete search history.

(56) References Cited

U.S. PATENT DOCUMENTS 3,989,287 A * 11/1976 Sheesley ..... 292/201
4,148,111 A 4/1979 Lieberman
4,290,390 A * 9/1981 Juzi ..... 122/406.4
4,573,238 A * 3/1986 Phillips ..... 16/79
4,660,250 A 4/1987 Tillman et al.
4,809,197 A * 2/1989 Tashiro et al. ..... 702/35
4,878,265 A * 11/1989 Nesbitt ..... 16/49
4,967,444 A * 11/1990 Korling et al. ..... 16/58
4,979,261 A * 12/1990 Lasier et al. ..... 16/62

(Continued)

FOREIGN PATENT DOCUMENTS

DE 34 23 242 C1 11/1986

(Continued)

OTHER PUBLICATIONS

European Search Report dated Jul. 4, 2007 w/English translation of pertinent portion (five (5) pages).

*Primary Examiner*—Victor Batson
*Assistant Examiner*—David C Reese
(74) *Attorney, Agent, or Firm*—Crowell & Moring LLP

(57) ABSTRACT

A drive system for a moveable wing, especially for a door or a window, is described. The drive system includes at least one energy storage device by whose discharge of energy the wing is moved. The energy storage device is hereby controllable in its energy discharge by means of a control system. The control system has an electrically controllable control element. The motion of the wing is directly or indirectly detected by a sensor, whose output signal is fed into a regulating device, which controls the control element. The regulating device is realized in a way, that the influence of the control element, dependent on the motion of the wing, can change the energy discharge of the energy storage device.

42 Claims, 4 Drawing Sheets

U.S. PATENT DOCUMENTS

| | | | | | |
|---|---|---|---|---|---|
| 4,995,194 | A | * | 2/1991 | Schultze et al. | 49/32 |
| 4,999,872 | A | * | 3/1991 | Jentsch | 16/58 |
| 5,142,735 | A | * | 9/1992 | Konishi | 16/82 |
| 5,243,735 | A | | 9/1993 | O'Brien | |
| 5,386,885 | A | * | 2/1995 | Bunzl et al. | 185/40 R |
| 5,417,011 | A | * | 5/1995 | Keszthelyi | 49/334 |
| 5,513,467 | A | * | 5/1996 | Current et al. | 49/340 |
| 5,515,649 | A | * | 5/1996 | Strab | 49/280 |
| 5,687,451 | A | * | 11/1997 | Singer | 16/71 |
| 5,687,507 | A | * | 11/1997 | Beran | 49/340 |
| 5,746,250 | A | * | 5/1998 | Wick | 137/624.11 |
| 5,850,671 | A | * | 12/1998 | Kaser | 16/79 |
| 5,862,630 | A | * | 1/1999 | Krumhauer et al. | 49/341 |
| 5,956,249 | A | * | 9/1999 | Beran et al. | 700/56 |
| 6,138,412 | A | * | 10/2000 | Rieckmann et al. | 49/349 |
| 6,151,753 | A | * | 11/2000 | Salutzki | 16/62 |
| 6,366,080 | B1 | * | 4/2002 | Eberhart et al. | 324/207.22 |
| 6,412,224 | B1 | * | 7/2002 | Feucht et al. | 49/340 |
| 6,439,539 | B1 | * | 8/2002 | Powell | 251/87 |
| 6,675,535 | B2 | * | 1/2004 | Armstrong et al. | 49/340 |
| 2002/0104266 | A1 | * | 8/2002 | Ranaudo | 49/334 |

FOREIGN PATENT DOCUMENTS

| | | | |
|---|---|---|---|
| DE | 3235837 | | 8/1987 |
| DE | 9102344 | | 6/1991 |
| DE | 3823487 | | 6/1994 |
| DE | 19514610 | | 11/1995 |
| DE | 19726021 | | 12/1998 |
| EP | 0 662 660 | A1 | 7/1996 |
| EP | 0 764 752 | A2 | 3/1997 |
| JP | 09112123 | | 4/1997 |
| WO | WO 92/12316 | A1 | 7/1992 |

* cited by examiner

DRIVE SYSTEM FOR A DOOR OR WINDOW AND METHOD OF OPERATING SAME

BACKGROUND AND SUMMARY OF THE INVENTION

This application claims the priority of German Application No. 102 09 268.0 filed Mar. 1, 2002 and German Application No. 102 59 925.4 filed Dec. 20, 2002, the disclosures of which are expressly incorporated by reference herein.

The invention relates to a drive system for a movable wing, especially for a door or a window.

German Patent Document No. DE 91 02 344 U1 shows a drive system, realized as a door closer, for automatically closing a pivoted wing, which is realized as a door wing. An energy storage device activates a displaceable piston in the door closer housing in closing direction, allowing the door to be closed by the action of the energy storage device. The closing procedure is dampened by means of a control system, which is realized as a hydraulic damper.

The damper has various sub-functions, for instance a dashpot and a so-called end position just prior to reaching the closing position. Each of these sub-functions requires a separate housing duct, as well as a separate control valve. This involves a complex manufacturing process, as well as complex adjustments on the assembled drive system.

Another disadvantage is the fact, that the damping properties of the damper, e.g. the onset of the end position, are determined by the geometrical arrangement of the corresponding duct outlet in the drive system housing. Changes of the damping properties are only possible, by changes on the piston or housing of the drive system, e.g. by exchanging them.

A further disadvantage arises from the fact, that even though the flow diameters of the damping control valves can be adjusted manually, changes of the ambient conditions, especially the ambient temperature, are, however, not adjusted. The viscosity of the damping medium, however, is dependent on its temperature, thus also changing the damping properties. In order to maintain the desired damping properties, a manual readjustment of the damping control valves is required, when temperatures change.

From U.S. Pat. No. 4,148,111, a drive system, realized as a door closer, for automatically closing a pivoted door wing is known. It comprises a housing, wherein an output actuator, realized as a closer shaft, is pivoted. Through a transmission, realized with pinion and steering gear, the closer shaft works in combination with a piston, which can be linearly displaced within a housing, wherein e.g. a mechanical energy storage device, realized as closer spring, activates the piston in closing direction. A control system, realized as hydraulic damper, with a valve installed in an overload duct between two of the housing chambers, which are limited by the piston, is planned for dampening the closing procedure. The damper is realized in a way, that the damping of the motion of the wing in closing direction is automatically adapted to changes in the ambient temperature, by the valve having a plastic element defining the flow diameter, which changes its volume when the ambient temperature changes. The plastic element expands, when the temperature increases, thus reducing the flow diameter accordingly. This makes feasible that, independent of changes in temperature and the resulting changes in viscosity of the damping medium, a constant flow of the damping medium through the valve is guaranteed, as well as, that the damping of the closing motion is therefore independent of the temperature.

A disadvantage of the shown drive system is the fact, that even though an adjustment to the described changes in viscosity of the damping medium are secured, an automatic adjustment to other specific operating conditions, which are caused by changes of further ambient conditions, are not part of the design. For example draft inside of a building or wind, can cause the wing to not close completely, especially when the resistance of a lock catch has to be overcome, when the closed position is reached. Even though the dashpot can be set by manual adjustment of the valve, this setting will always be a compromise, because at low dashpot, which guarantees a secure closing of the wing even in draft conditions, the wing would fall heavily and with a lot of noise into the closed position, when the draft condition is not present at some point.

An object of the invention to create a drive system, which can be flexibly used for various types and sizes of wings, with an ease of assembly, and which guarantees a comfortable operation and at the same time secure closing of the wing, irrespective of any ambient conditions. In addition, the manufacturing for the drive system is intended to be low-cost.

This and other objects are achieved according to certain preferred embodiments of the invention by providing a drive system for a movable wing, especially for a door or a window, with at least one energy storage device, by whose discharge of energy the wing is moved, wherein the discharge of energy from the energy storage device can be controlled by means of a control system, wherein said control system includes an electronically controllable control element, wherein the movement of the wing is either directly or indirectly detected by a sensor, whose output signal is fed to an input of a regulating device, which controls the control element, and wherein the regulating device is realized in a way, that the control element, dependent on the movement of the wing, can be changed in its influence on the energy discharge from the energy storage device.

The control system has an electrically controllable control element, wherein the motion of the wing is directly or indirectly detected by a sensor, whose output signal is fed into an input of a regulating device, which controls the control element. The regulating device is realized in a way, that the influence of the control element on the energy discharge from the energy storage device can be changed, dependent on the motion of the wing. Thus a cycle of motion of the door drive is made possible, which is fitted to the actual motion of the wing in the meaning of a regulation.

In preferred embodiments of the drive system, the sensor detecting the motion of the wing is realized as a rotary sensor, for instance a pulse sensor or an absolute value rotary encoder. The rotary sensor can be installed at the output actuator of the door drive.

As an alternative, the motion of other components, which are gear-connected to the output actuator, e.g. a piston, which can be displaced linearly in the drive housing, may be detected. This may be done for instance by means of hall effect sensors or reed switches.

In a divergent embodiment of the drive system, instead or in addition to the detection of the output actuator motion, the swivel motion of the wing can be detected. The sensor can then be installed in the area of the axis of the door rotation and can be realized as rotary sensor. In a drive system with a sliding arm and a sliding rail, the sensor can also detect the linear movement of the sliding element in the sliding rail, for which a hall effect sensor is suitable.

As an alternative or in addition—in regards to drives filled with hydraulic medium—pressure sensors can be installed in the housing chambers of the drive housing. The detected pressures are fed into the regulating device, and are evaluated as measuring values for the operating statuses of the drive system. In a parallel detection of the wing motion and the housing chamber pressures, a highly sensitive processing of the operating statuses of the drive system is made possible and therefore rapid reactions to changes compared to set values.

Measuring the flow rate of the hydraulic medium in the duct between the housing chambers is also contemplated by certain preferred embodiments of the invention. For this purpose a sensor can be installed in this duct for detecting the flow rate. The detected flow rate is fed into a regulating device and is evaluated as a measuring value for the operating statuses of the drive system. Here too, a highly sensitive processing of the operating statuses of the drive system and therefore a rapid reaction to changes compared to set values is made possible, in a parallel detection of the output actuator motion and the flow rate, The regulating device may include a computer device, a memory device, as well as an electrical energy storage device. The electrical energy storage device may also be realized as a replaceable battery. In preferred embodiments, the electrical energy storage device is realized as an accumulator. As an alternative, the electrical energy storage device may be realized as a capacitive energy storage device, i.e. as capacitor, for example as so-called gold-cap-capacitor. Another option for supplying power to the drive system is the employment of a fuel cell.

As an alternative or in addition, the door drive can of course be connected to a power supply network.

The output signal of the sensor, which can for instance be realized as a multi-polar rotary sensor, is fed to an input of the regulating device. Parameters for the possible operating conditions of the drive system are stored in the preferably non-aligned memory device of the drive system. In the computer device of the regulating device, the stored parameters are compared to the output signals of the sensor. In the computer device, the aperture angle setting, as well as the rate of wing motion attached to the drive system, are directly derived from these signals.

It may be planned for instance, that high rates of wing motion at high aperture angles of the wing in closing direction, are acceptable; however, that starting from a specific low aperture angle of the rate of wing motion, the rate will be decelerated to a predetermined lower value. As an alternative or in addition, it may be planned, that the dashpot—especially in doors with engaging lock catches—is reduced again or cancelled shortly before reaching the closed position, thus allowing for a reliable engagement of the lock catch. It may be planned for the opening motion, that the wing remains undamped up to reaching a certain aperture angle, i.e. is opened solely against the force of the compressed closer springs, and that starting from this specific aperture angle, the damping of the opening motion sets on, which prevents the wing from hitting against a part of the building, e.g. a wall.

In a further embodiment of the object of the invention, a rate of motion profile of the wing may be stored in the memory device, wherein each aperture angle position of the wing is assigned an optimized rate of motion for the opening motion as well as closing motion.

This continuous profile of reference values can achieve, that the damping doesn't set on abruptly at a certain point, but that already very low deviations of the rate of motion from the stored motion profile, will result in an immediate and exact adjustment of the damping, thereby achieving a very sensitive control. A high wing opening speed may lead to a higher opening damper than a slower wing movement. On the other hand, an opening damper may be done without altogether, as necessary, when the opening motion is very slow. In addition, a compensation for environment-related changes of the motion properties of the drive system is made possible, for instance in temperature-related changes of viscosity of the damping medium.

Apart from the parameters, which are relevant for the wing motion rates, further parameters my also be stored in the memory device of the regulating device. An open-period may be defined for instance, so that the wing does not close immediately following the opening process, but only releases for closure, after the open-period has elapsed.

The control system can fully take over the functions of a traditional locking system and thus replace it. After manually opening the wing, it remains in an open-position, which can be predetermined, until the locking position is cancelled; for example by interrupting the power supply to the control element. Therefore the drive system can be used on fire protection doors, wherein a reliable closing of the wing by the drive system is secured, after a smoke detector signal is detected or after an interruption of the power supply.

The cancellation of the locking position of the wing may also be initiated by manually moving the wing in closing direction. To achieve this, a motion of the output actuator over a predetermined path can be detected—with the locking system enabled—and can be evaluated as initiating signal for canceling the locking position. As an alternative or in addition—with additional detection of the housing chamber pressure—, the increase in pressure in one of the housing chambers, which occurs when the lock is activated and wings are manually actuated, may be evaluated as initiating signal for canceling the locking position.

A further area of application of the drive system—in combination with a special freewheeling linkage—consists in the so-called "free-swing"-function. The control element locks the closer spring, similarly as in the previously described locking function in tensioned position. The linkage coupling to the output shaft of the drive system allows for a relational motion between the locked output shaft and the power transmitting linkage, so that the wing can move freely, without having to overcome the power of the closer spring, as long as the closer spring is in a locked position. Here too, the cancellation of the power supply to the control element causes a cancellation of the closer spring locking, so that the wing can be closed through the force of the spring.

The control element has to be realized in a way, that it can rapidly and exactly react to the driver signals of the regulating device. An advantageous embodiment of the control element is an electrically controllable valve, which is installed in an overload duct, which connects two housing chambers located on both sides of the piston.

The electrically controllable valve may for example be realized as a bi-stable solenoid, whose flow diameter can be regulated by clocked switching between the two positions "open" and "closed". Depending on the ratio of the "open" and "closed"-impulses to each other, the flow mass may be set to continuously adjustable, wherein a change of flow mass can be realized very rapidly.

In a divergent embodiment, instead of a single solenoid, a valve cascade consisting of several parallel-configured valves may be installed. The valves of the valve cascade, which are preferably realized as bi-stable solenoids, can be activated individually, wherein the flow diameter of the valve cascade is higher, the more valves are open. The gradation of the realizable flow diameters is dependent on the number of the individual valves, i.e., the more valves are installed parallel to each other in the cascade, the better the fine-tuning of the gradation of the flow diameters.

As an alternative, the employment of a valve is conceivable, whose flow diameter can be continuously adjusted by means of a high-speed servo motor and remains on this respective value after the last driver signal; this means, that here, driver signals are only necessary for changing the flow diameter. The employment of other valve actuators not described here, is conceivable, if they have the appropriate properties, for example piezoelectric actuators or thermal actuators.

In a further embodiment, the control system may be realized as a brake system, so that the filling of the drive system with a damping medium may be done without, as necessary. The mechanical brake system may act on a moveable element of the drive system, for example directly on the closer shaft or on one of the braking discs, which is installed and tightened on the closer shaft, or on the piston.

In a further embodiment the control element may be realized as an electric generator. Here too, the filling of the drive system with damping medium may be done without, as necessary. During the regenerative braking action, the generator generates electrical energy, which is fed to an electrical resistor. As an alternative or in addition, the electrical energy can be fed to the energy storage device of the regulating device.

It is planned, that the electrical energy storage device is exchangeable or that it is charged through the power supply network of the building. In the latter case, the power feed—in case the drive system is mounted on the wing—may for instance occur via the power transmitting linkage. As an alternative or in addition, solar cells, which supply the electrical energy storage device with electrical energy, may be installed either on the drive system, on the wing, or stationary.

The regulating device of the drive system may also have further in- and outputs, e.g. for the connecting the drive system to a central control center. Thus, central monitoring of the operating condition of the connected drive systems, as well as any contingent intervention in the operating mode of the drive system is made possible.

A warning sensor device may be installed in the motion section of the wing, whose output signal is processed in the regulating device, and which causes a severe damping of the wing motion and if necessary complete standstill, when an obstacle is present in the motion section, which prevents the wing from crashing against the obstacle. It may be planned to integrate the warning sensor in the housing of the drive system. This has the advantage, that the evaluation of the signals of the warning sensor is performed in the regulating device of the drive system, which makes separate evaluation electronics unnecessary.

The warning sensor device may specifically secure the side closing edge of the wing, which forms a crimp and shear site, i.e. if a body part or an object gets in the area of the side closing edge while the wings are closing, the wing movement is stopped.

In addition, sensors for the ambient conditions, for instance for temperature, rain or wind, may be incorporated. Thus, the drive system can be run, while adjusted to the ambient conditions; e.g. the closing motion may be performed faster with cold ambient temperatures, rain or strong winds, than with warmer ambient temperatures, dry or no wind conditions, in order to avoid the cooling down, draft or wet conditions entering into the interior space, which is enclosed by the wings.

Already mentioned was the connection of smoke detectors, in order to close the wing with an activated locking function in case of fire. It may be planned here, that the measuring unit of the smoke detector is integrated in the housing of the drive system; this provides the advantage, that the evaluation of the signals from the measuring unit is performed in the regulating device of the drive system, which makes separate evaluation electronics for the measuring unit of the smoke detector unnecessary.

In principle, the connection of any suitable external driver element or sensor is possible, which—installed on an appropriate site of the wing or in its vicinity—are planned for canceling the locking position or for making any other change to the operating status of the drive system, e.g. door opener contact, or also authorization switches, e.g. key-operated switches, keypads, code reader or biometric sensors.

All of previously described operating parameters, which are stored in the memory device of the regulating device, may be stored already by the manufacturer. It may also be planned, that the parameters can be entered, changed and stored at any time, after the drive system is already installed. For this purpose, an interface my already exist in the regulating device, wherein the entry and/or change of the operating parameters may for example be performed via a service terminal, which needs to be connected, or via a traditional PC. For this purpose, it is not imperative, that the PC be installed in physical vicinity of the drive system, since a data transmission is also possible via the computer net from the building or the internet. If the drive system is connected to a central control center, the entry and/or change of the operating parameters may be performed from there as well. A wireless transmission for entry and/or change of operating parameters is also conceivable, wherein the regulating device must consist of a transmitter-/receiver-unit.

In an advantageous embodiment of the drive system, the interface may be realized as a bus interface, which allows for the connection of the drive system to a bus system, which is available inside the building. The previously described external sensors may also be usable in the bus, and may be connected to the regulating device via this bus interface, which reduces wiring work considerably.

It is possible as a further embodiment, to store the operating parameters, which are to be stored in the regulating device, by manually moving the wing according to the desired cycle of motion, when starting operation of the drive system, wherein the signals of the sensor, which detects the motion of the output actuator, are evaluated in the computer device and are processed into the operating parameters for the cycle of motion.

The memory device may also have a time registration device, by means of which protocols of the operating conditions of the drive system can be created. These stored protocols may be retrieved for diagnostic purposes.

A further embodiment of the drive system includes a motorized adjustment of the spring force. On the one hand, the closer spring gets support from the piston and on the other hand from a spring cup, which is displaceable in the drive housing. The spring cup is displaced by means of an electrically powered actuator, for instance an electric motor, whose spindle engages in the spring cup. As an alternative, the employment of an electrochemical actor is also conceivable. The essential aspect is, that a movement of the spring cup changes the preload of the closer spring. In combination with the previously described detection of the motion of the output actuator of the drive system, as well as the set/actual value comparison of these measured values with a stored motion profile, it is possible, to increase or reduce the force of the closer spring, as necessary.

It may be planned for instance, that when manually opening the wing, the force used in a first aperture angle section, starting from the closed position, should be as low as possible, whereby in the further opening procedure, an increase of the spring force, if necessary, even in the meaning of an opening damper which rapidly increases just before the complete open-position is reached, may be quite tolerable, or even desirable. In this case, the closer spring has a relatively low preload in the closed position of the wing, and when opening the wing, the spring—besides the forced compression by the piston movement—will be additionally compressed by the spring cup, as necessary. This additional compression may, however, also only occur, when the wing is already completely open, in order to have enough spring force for the subsequent closing cycle, or it may be planned, that the additional compression only occurs when the wing is closed by the force of the spring, especially in a case when the closing speed is lower than the set value stored in the motion profile.

The result is, that—at the lowest possible opening resistance of the wing—the maximum possible closing force is available. An important aspect in this embodiment is also, that the drive system—based on the comparison of the actual motion with the stored motion profile—is flexible and can rapidly react to variations hereof, in order to guarantee a secure closing of the wing.

It may also be planned for this embodiment, that the operating parameters are determined within the framework of the "programming", to be performed when starting the operation of the drive system, or by entering the door parameters (e.g. dimensions and weight of the wing(s)). This allows for customized adjustment of the drive system to the door which it drives; for example, the closing force for normal operation is set in a way, that it is just sufficient to close the wing securely during normal operation. For certain emergency situations, the spring force can be increased to the highest possible value, in order to bring about an especially rapid, high-powered closing.

A further embodiment of the drive system includes a motorized opening assist. Instead of an electrically controllable valve, a hydraulic pump is installed in the overload duct. The pump is driven by an electric motor, wherein the electric motor is connected to the regulating device. If the force used in a first aperture angle, starting from the closed position, is supposed to be as low as possible, the electric motor, via the regulating device, which has detected the manual opening of the wing attached to the drive system by means of a signal from the sensor, is driven in such a way, that the hydraulic medium is transported from the housing chamber, which gets smaller in the opening cycle, into the housing chamber, which enlarges when the wings open. This leads to the development of overpressure in the latter housing chamber, which charges the piston in opening direction; therefore less force is needed for the manual opening of the wing. The activation of the pump can be done, dependent on the opening speed as well as the opening position of the wing. For this purpose—as already described repeatedly—a motion profile may be stored in the memory device of the regulating device. The electric motor of the pump will be driven, based on the comparison of the actual wing motion to the stored motion profile.

It may be planned additionally, that the pump is realized as a reversible pump, i.e. a pump, which can be operated in both flow directions. This allows for a change of direction of the electric motor of the pump, shortly before the open position of the wing is reached—again as necessary, considering the rate of wing motion—, i.e. the pump transport direction is reversed. This makes an opening damper function feasible.

In order to realize an open-position function, it may be planned additionally, to regulate the transport volume of the pump at the complete open position of the wing in such a way, that the wing is held in this position against the force of the mechanical energy storage device.

In the closing motion of the door wing, the pump acts like a turbine, i.e., the passing hydraulic medium makes the pump rotate. The electric motor works here as a regenerative brake, wherein the braking action of the regulating device is controlled based on the comparison of the actual wing motion to the stored motion profile. An "end-position"-function can be realized, by withdrawing or canceling the braking action shortly before the closed position of the wing is reached.

In case the closing speed of the door wing falls below a predetermined set value, the pump can be reversed again, so that it supports the flow of the hydraulic medium, which occurs when closing, and therefore the mechanical energy storage device within the meaning of a reliable closing of the wing.

The following applies to all examples of embodiments: Since the functions of the drive system are programmable, and since the control element can perform a multitude of functions simultaneously, the drive system can be employed in the most flexible ways. The "end-position"-function, for example, can be enabled as necessary, without the need for any changes on the mechanical construction of the drive system. A variety of additional components, such as separate locking devices, can be done without, since the control element takes over this function. In the drive housing, a multitude of hydraulic ducts can be done without, since the functions of traditional valves and hydraulic ducts for opening damper, dashpot and end-position for example, are combined in the control element.

When installing two drive systems on a two-winged door with folded-under standing wing and folded-over drive wing, it is possible, that the two drive systems communicate with each other via the electric inputs and outputs, or interface, within the meaning of a closing sequence control, so that the drive wing is blocked in a partially or completely open position, until the standing wing has reached its closed position. When starting the operation of the system, one drive system is assigned to the drive wing, and the other drive system is assigned to the standing wing, by programming them accordingly. The minimum partial open position of the drive wing is stored in the already previously described motion profile. It may be planned, that the regulating device of one drive system, for example of the standing wing drive system, takes over the "master"-function and the regulating device of the other drive system is subordinated as "slave"-regulating device. Communication between the regulating devices may occur on a wire-based or wireless basis, wherein the latter option reduces the wiring work considerably.

Other objects, advantages and novel features of the present invention will become apparent from the following detailed description of the invention when considered in conjunction with the accompanying drawings.

DETAILED DESCRIPTION OF THE DRAWINGS

Figure 1:
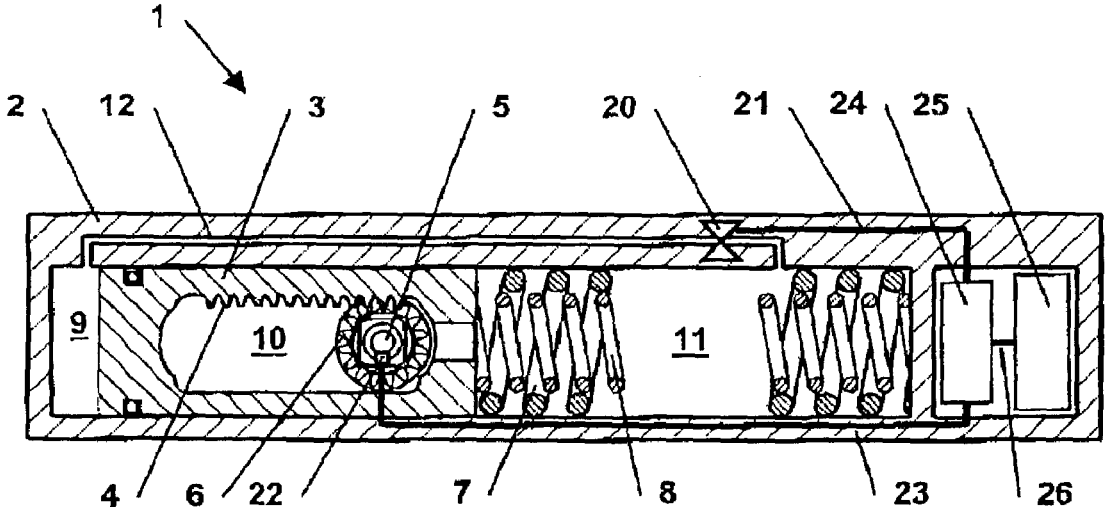
FIG. 1 illustrates a drive system with hydraulic damping in a sectional view.

FIG. 1 shows a drive system 1, realized as door closer. The drive system 1 includes a housing 2 which in use is installed on a pivoted wing or on a stationary doorframe. As an alternative, the integrated installation of the housing 2 into the frame is also contemplated. The linearly displaceable piston 3 in the housing 2, is realized as a hollow piston and has a gearing 4 in its interior, which works in combination with the pinion 6 of an output actuator 5, which is realized as a closer shaft and pivoted in the housing 2. At the end of the output actuator 5, a power-transmitting linkage is installed and tightened; this can be realized as sliding arm or as shear arm and connects the drive system 1—depending on the type of assembly—to the stationary door frame or wing. The piston 3 divides the interior of the housing 2 into two housing chambers 9, 11. Two mechanical energy storage devices 7, 8, realized as closer springs, are installed coaxially to each other inside of the right housing chamber 11, and whose right end (in drawing) gets support from the walls of the housing 2, and whose left end gets support from the right head end of piston 3. The mechanical energy storage devices 7, 8, therefore charge the piston 3 towards the left; a movement of the piston 3 towards the right causes a compression of the mechanical energy storage device 7, 8. This equals one turn of the output actuator 5 in clockwise direction, which occurs, when the connected wing is opened manually. The energy stored by the compression of the mechanical energy storage device 7, 8, is available for the automatic closing of the wing after it has been released. With the mechanical energy storage device releasing, the piston 3 is then pushed towards the left, while the output actuator 5 turns counterclockwise.

To allow for a damped closing motion of the wing, the interior of the housing 2 is filled with a damping medium, e.g. with hydraulic fluid. Since the piston 3 moves towards the left when closing, it displaces damping medium from the left housing chamber 9, through the overload duct 12, which is installed in the longitudinal wall of the housing, to the right housing chamber 11.

An electrically controllable valve 20 (shown in a schematic diagram) is positioned in the overload duct 12. This valve can e.g. be realized as a solenoid; as an alternative, the valve body may also be controlled by a rotating electric motor or by piezo-actors or similar components. The electric driver of the valve causes—irrespective of the concrete embodiment—a change of its flow diameter. The operating types of the drive system 1 made possible by the electrical driver of the valve, are described in detail in another section.

A sensor 22 is installed and tightened on the output actuator 5. This sensor 22, which is realized as a multi-polar pulse sensor, converts the turning motion of the output actuator 22 into electrical signals. The signals from the sensor 22 are fed to an electronic regulating device 24 installed in housing 2, via an electrical line 23; this electronic regulating device receives the electrical energy necessary for operation through an electrical line 26 from an electric energy storage device 25, realized as an accumulator, which is located in the housing 2 as well. An output of the regulating device 24 is connected with the actor of the valve 20 via a further electrical line 21, which runs through the housing 2.

Figure 2:
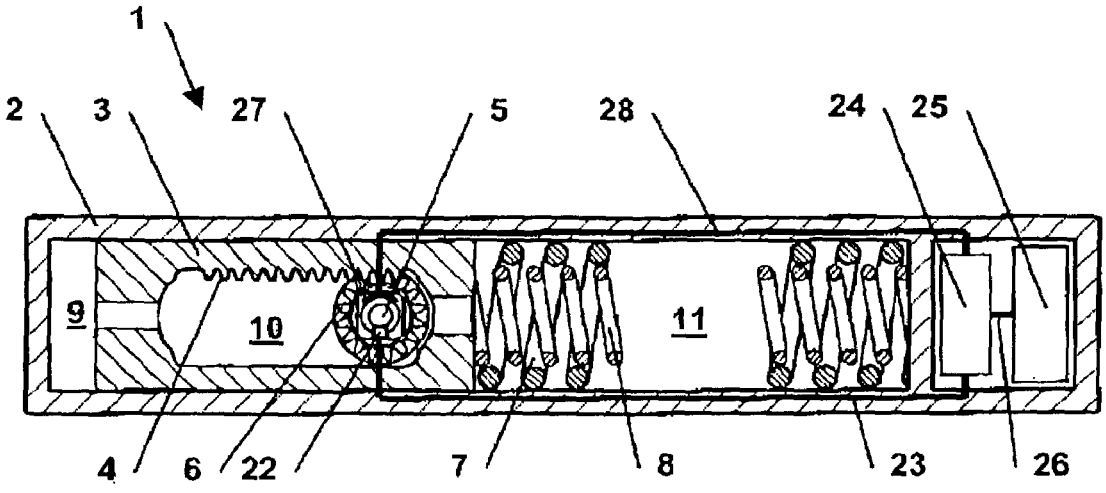
FIG. 2 illustrates a drive system with a mechanical brake (damping) in a sectional view.
Figure 3:
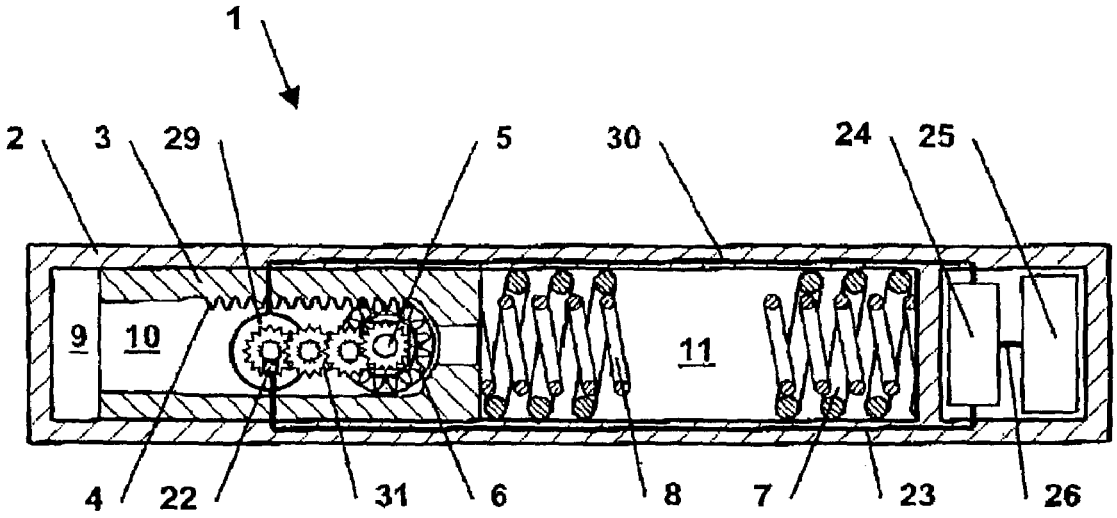
FIG. 3 illustrates a drive system with a regenerative brake (damping) in a sectional view constructed according to certain preferred embodiments of the present invention.

FIGS. 2 and 3 show variations of examples of embodiments of a drive system 1. The basic construction of the drive system 1 with housing 2, piston 3, gearing 4, output actuator 5 with pinion 6 as well as mechanical energy storage devices 7, 8, corresponds to the example of embodiment shown in FIG. 1. The described assembly types as well as the therein described motion cycles of the output actuator 5 and the piston 3, also apply to the examples of embodiments according to FIGS. 2 and 3. The installation of a sensor 22 of a shaft, as well as feeding the signals of the sensor 22, via an electrical line 23, to an electronic regulating device 24 installed in the housing 2, which is supplied by an energy circuit 25, correspond to the previous example of embodiment as well.

Instead of the valve installed in the hydraulic cycle, the drive system 1 has a mechanical brake system 27 according to FIG. 2. Filling of the housing 2 with a damping medium can even be done without, if necessary, in this example of embodiment, unless the medium is necessary for lubricating the moveable parts. The electrically controllable brake system 27 is connected to an output of the regulating device 24 via an electrical line 28, and acts directly on the output actuator 5, or on a brake element, which is tightly connected to it, e.g. on a brake disc.

The drive system shown in FIG. 3 includes a regulating device containing a generator 29. The generator 29 is connected to the output actuator 5 by means of a transmission gearing 31, so that a slow rotation of the output actuator 5 causes a fast rotation of the generator 29. The generator 29 is also connected to the regulating device 24 via an electrical line 30. The sensor 22, which detects the turning motion of the output actuator 5, is installed on the fast turning shaft of the generator 29 in this example of embodiment. The brake action of the generator 29 is achieved, in that the regulating device 24 connects a variable electrical resistor housed in the regulating device, to the generator 29. As an alternative or in addition, the electrical energy generated in the regenerative braking action, may be fed into the electric energy storage device 25.

Figure 4:
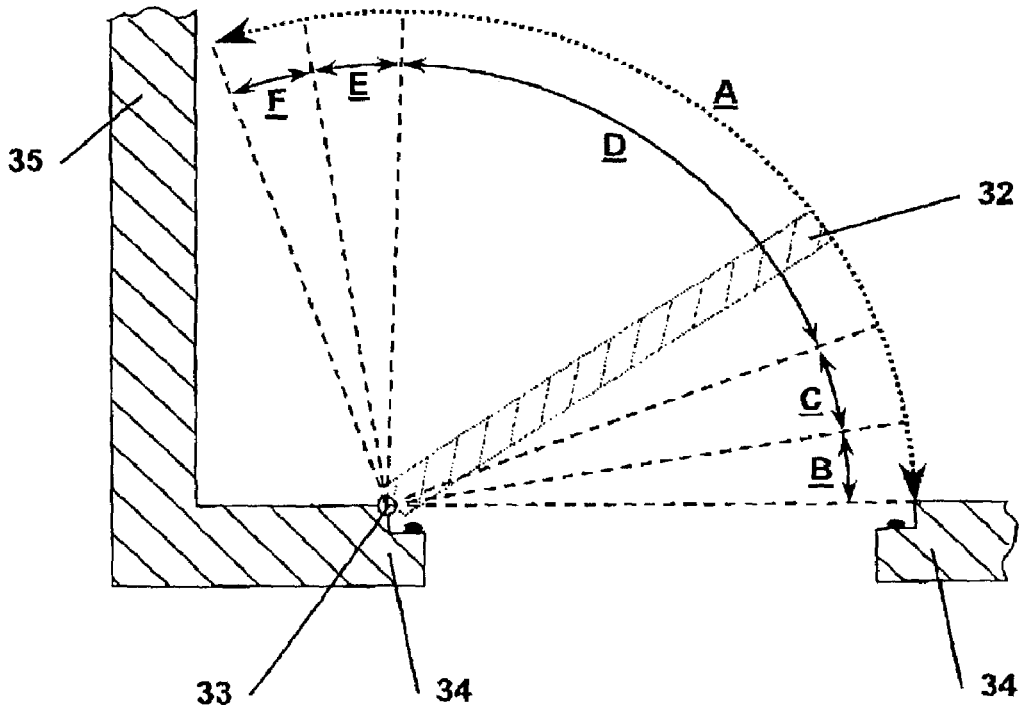
FIG. 4 illustrates an aperture angle section of a wing connected to a drive system in top view for systems constructed according to certain preferred embodiments of the present invention.

FIG. 4 shows a wing 32, which is pivoted on a door case 34 by means of a pivot joint. The total aperture angle A of the wing 32, which is equipped with a drive system (not shown here) according to the previous examples of embodiment, is bounded on the one side by the closed position of the wing 32, and on the other side by a wall 35. Following is the description of an example of a complete opening and closing cycle of the drive system:

In the complete opening motion, the wing 32 moves counterclockwise through the aperture angle sections B, C, D, E and F. In the first aperture angle sections B to E, the wing 32 is only moved against the force of the mechanical energy storage device without any activated damping, and when it reaches the last aperture angle section F, the control system is activated, in order to prevent the wing 32 from crashing against the wall 35, or against the bump stop. A constant damping may be planned for the complete aperture angle section F, or damping may continuously increase when moving through the aperture angle section F. Above all, the actual opening speed can be decelerated to this set value, by comparing it with a stored preset opening speed, and by continuously controlling the damping.

In the closing motion, the wing 32 moves clockwise through the aperture angle sections F, E, D, C and B. In the first three aperture angle sections F to D, the damping of the closing motion is relatively low, so that a rapid closing motion of the wing 32 can be achieved in these first aperture angle sections F to D. When the wing 32 reaches the next to last aperture angle section C, a stronger damping begins, in order to decelerate the wing 32 from the high closing speed, down to a low closing speed. The damping may again be constant throughout the complete aperture angle section C or increase continuously—with or without control by set/actual value comparison of the closing speed. When the wing reaches the last aperture angle section B, the damping is withdrawn again, in order to overcome the resistance of the lock catch and therefore realize the so-called end position. Here too, a constant, as well as a continuously decreasing damping action—with or without control by set/actual value comparison of the closing speed—is conceivable.

If the door does not have a lock catch, the closing motion may proceed differently: In this case, the damping of the closing motion is relatively low in the aperture angle sections F to C, so that a rapid closing motion of the wing 32 can be achieved in these first aperture angle sections F to C. When the wing reaches the last aperture angle section B, a higher degree of damping begins, in order to decelerate the wing 32 from the high closing speed down to a low closing speed. The damping may again be constant throughout the complete aperture angle section C or increase continuously—with or without control by set/actual value comparison of the closing speed. In deviation from the example of embodiment with lock catch, the deceleration from the high closing speed down to the lower closing speed starts at a later point, so that the wing 32 can cycle through a wide aperture angle section with high closing speeds and therefore the most rapid closing of the wing 32 possible, is realized.

The end position may be connected or disconnected, depending on the type of door, on which the drive system is being used.

An additional special operating property of the drive system may for example be necessary, when the last aperture angle section F in opening direction is blocked by means of an obstacle, which is left there. In this case, the control system must activate already in the next to last aperture angle section E, in order to prevent the wing 32 from crashing on the object.

In deviation from the five fixed aperture angle sections shown in FIG. 4, less or more fixed aperture angle sections may be planned as an alternative. If the total aperture angle A is divided into a multitude of aperture angle sections, the result is an almost continuous motion speed profile for the opening as well as for the closing motion. This almost continuous motion speed profile allows for an extremely fine-tuned control of the motion speed by the multitude of set/actual value comparisons, wherein possible deviations from the set value are immediately corrected by an adjustment of the damping.

The necessary operating parameters, such as the total aperture angle, the aperture angle sections—if needed, with the respectively assigned preset motion speeds of the individual aperture angle sections—, as well as a continuous motion speed profile, as necessary, are stored in the memory device of the regulating device. The motion of the wing causes an output signal of control according to the motion, which includes the position of the wing as well as its direction and motion speed. The sensor signal (actual value) connected to the input of the regulating device is compared to the stored operating parameters (set value) in the computer device of the regulating device.

The control system is driven in such a way that possible deviations between the actual and the set values are balanced out.

Figure 5:
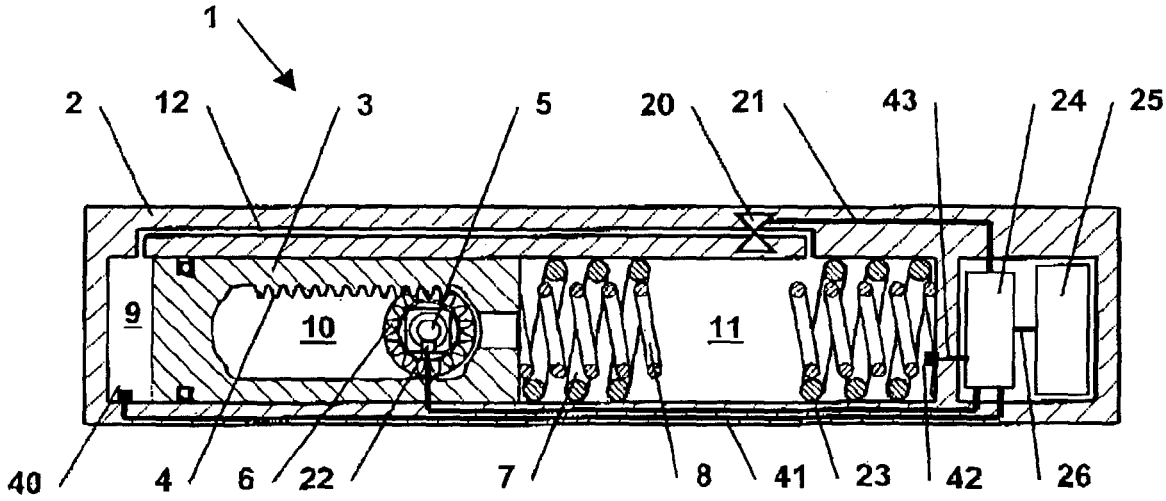
FIG. 5 illustrates a drive system with additional housing chamber pressure detection in a sectional view constructed according to certain preferred embodiments of the present invention.

The drive system 1 shown in FIG. 5 has additional pressure sensors 40, 42, compared to the drive system according to the example of embodiment in FIG. 1. One pressure sensor 40 is installed in the housing chamber 9, in which, due to the displacement of the piston 3, overpressure develops, when the wing is closed. The other pressure sensor 42 detects the pressure in the housing chamber 11, in which the mechanical energy storage devices 7, 8, are installed; when opening the wing with the opening damper activated, an overpressure develops here. The pressure sensors 40, 42, are connected to the regulating device 24 by means of electrical lines 41, 43.

Apart from the previously described detection of the output actuator 5 motion by means of the sensor 22, the pressures inside the housing chambers 9, 11, are detected in this embodiment. This can be used to secure the drive mechanism against impermissible high pressures, as they may for instance occur, when the closing door is pushed down with a rapid manual movement, or with rapid opening when the opening damper is activated. In this case the dashpot may then be withdrawn intermittently, so that the pressure in the housing chambers 9, 11, does not exceed a pre-determined limit. A further application of the pressure sensors 40, 42, provides, that a manual pressing of the wing in closing direction cancels out the locking position, when the locking function of the drive system 1 is activated; this is achieved in that the fact of exceeding the adjustable pressure limits in the housing chamber 9, is evaluated as a trigger signal for canceling the locking function. Especially in combination with the detection of the output actuator motion, very fine-tuned and rapid reactions of the drive system 1 to deviations of its operating statuses compared to the stored motion profile are made possible.

Figure 6:
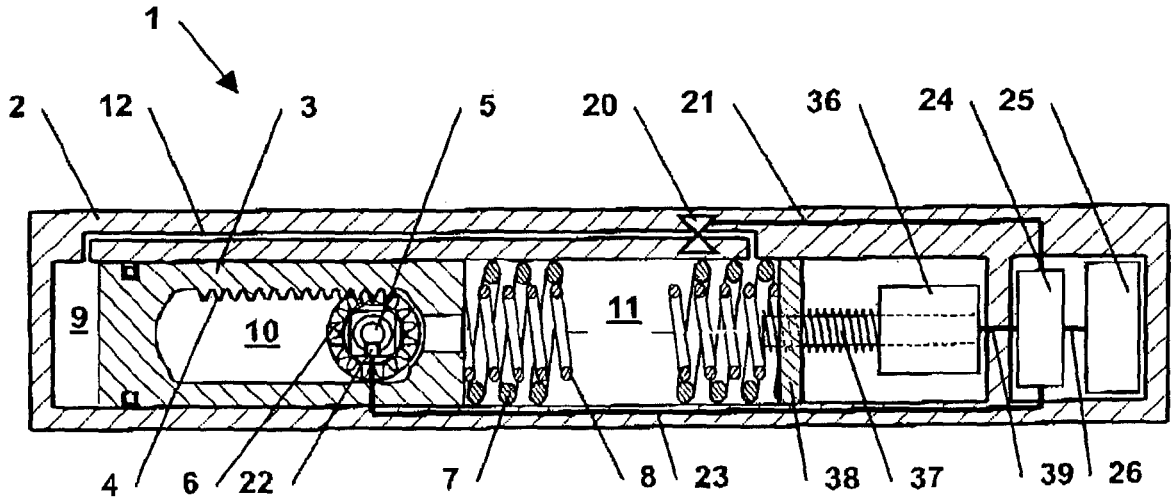
FIG. 6 illustrates a drive system with motorized closing force adjustment in a sectional view constructed according to certain preferred embodiments of the present invention.

FIG. 6 shows a drive system 1 with motorized closer force adjustment. The drive system 1 is basically constructed as the drive system shown in FIG. 1; in deviation thereof, the end of the mechanical energy storage devices 7, 8, which is not facing the piston 3, is not supported by the housing 2, but by a spring cup 38, which can be linearly displaced, parallel to the longitudinal axis of the housing 2. The spring cup has a threaded bore, into which a threaded spindle 37 engages, which is securely connected to the output shaft of an electric motor 36. When the electric motor 36 receives current through the electrical line 39, through which the electric motor 36 is connected to the regulating device 24, the threaded spindle rotates and causes a displacement of the spring cup 38 in the housing 2. A device for detecting the position of the spring cup is not shown; this may be realized, for example, as rotary sensor on the output shaft of the electric motor 36, or as linear position encoder, which detects the position of the spring cup directly. The detected position of the spring cup is evaluated in the regulating device. When the spring cup 38 moves towards the piston 3, the mechanical energy storage devices 7, 8, are compressed, which increases their piston-charging force 3. A motion of the spring cup 38 away from the piston 3, releases the mechanical energy storage device 7, 8, and reduces their force acting on the piston 3.

If the force exerted, when manually opening the wing during one of the first aperture angle sections starting from the closed position, is supposed to be as low as possible, the spring cup 38 is at the position, which is farthest from the piston 3, and the mechanical energy storage devices 7, 8, are therefore relatively relaxed, making the manual force needed to open the door relatively low. In the further opening cycle, an increase—or as needed even a strong increase for achieving an opening damper shortly before reaching the complete open position—in the force of the mechanical energy storage device 7, 8, is tolerable or even desirable. When opening the wing, the mechanical energy storage devices 7, 8, are additionally compressed—besides the forced compression by the movement of the piston 3—by the spring cup 38, as necessary. This additional compression may also only take place, when the wing is already completely opened, in order to have enough spring force available for the subsequent closing cycle, or it may be planned, that the additional compression only occurs, when the wing closes by means of the mechanical energy storage devices 7, 8, especially when the closing speed is lower than the set value stored in the motion profile. It may therefore also be important in this embodiment, that the drive system—based on the comparison of the actual motion to the stored motion profile—reacts flexibly and rapidly to deviations thereof, to guarantee a secure closing of the wing.

Figure 7:
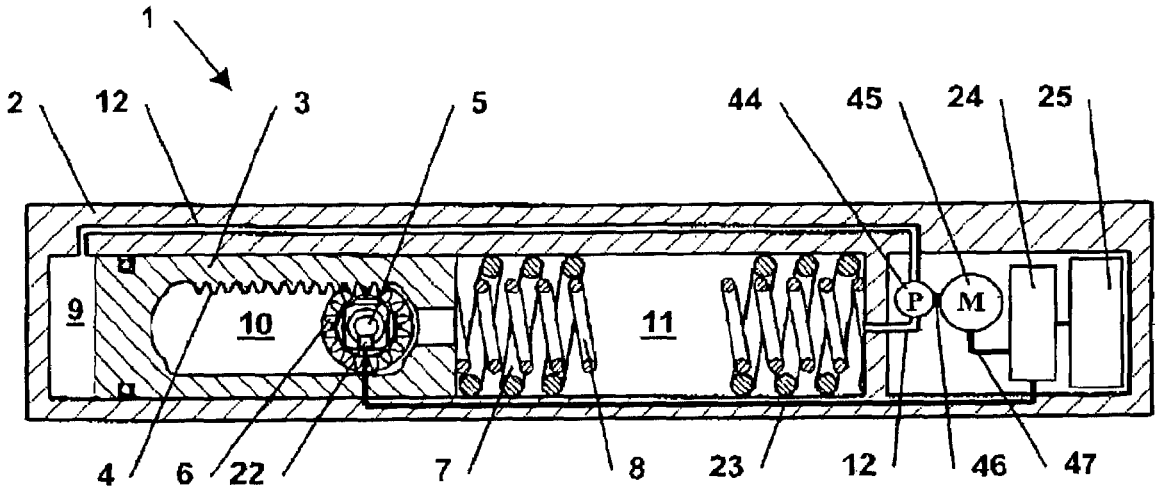
FIG. 7 illustrates a drive system with an electro-hydraulic pump in a sectional view constructed according to certain preferred embodiments of the present invention.

FIG. 7 show a drive system 1 with motorized opening assist. The drive system is basically constructed as the drive system shown in FIG. 1; in deviation thereof, a hydraulic pump 44 is installed in the overload duct instead of the electrically controllable valve. The pump 44 is driven by an electric motor via a clutch 46, wherein the electric motor 45 is connected to the regulating device 24, via an electrical line 47.

If the force exerted for opening the wing in one of the first aperture angle sections starting with the closed position, is supposed to be as low as possible, the electric motor 45 is controlled through the regulating device 24, after it has detected the manual opening of the wing connected to the drive system by means of a signal from the sensor 22, in such a way, that the hydraulic fluid is transported from the center housing chamber 11 in the drawing into the left housing chamber 9 in the drawing, which gets larger when the wing is opened. This causes an overpressure in the left housing chamber, which charges the piston 3 in opening direction; therefore much less force is required for opening the wing manually. The activation of the pump 44 can be effected, dependent on the opening speed, as well as on the open position of the wing. For this purpose, a motion profile can be stored in the memory device of the regulating device 24. The electric motor 45 of the pump 44 is driven, based on the comparison of the actual wing motion to the stored motion profile.

It may be planned additionally, that the pump 44 is realized as a reversible pump, i.e. a pump, which can be operated in both flow directions. This makes it feasible, that the electric motor 45 of the pump 44 changes the direction shortly before reaching the open position of the wing—here again, taking into consideration the rate of wing motion, as necessary—, i.e. the transport direction in the pump 44 is reversed. An opening damper function can be realized herewith.

By controlling the transport volume of the pump 44 in a complete open position of the wing in such a way, that the wing is held in this position against the force of the mechanical energy storage devices 7, 8, an opened position function can be realized. As an alternative, a valve (not shown here) can be installed in the overload duct 12, for the embodiment of an open position function, by inhibiting the overload duct 12.

In the closing motion of the door wing, the pump 44 acts like a turbine, i.e., the hydraulic medium flowing through it, puts the pump 44 into a rotary motion. The electric motor 45 acts here as a regenerative brake, wherein the braking action is controlled by the regulating device 24 based on the comparison of the actual wing motion to the stored motion profile. An "end position"-function is feasible by withdrawing or canceling the braking action shortly before the closed position of the wing is reached.

In case the closing speed falls below a predetermined set value, the pump 44 can change the direction anew, so that it supports the flow of the hydraulic medium, which develops when closing, and therefore supports the mechanical energy storage device within the meaning of a reliable closing of the wing.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A method of controlling opening and closing movements of a wing member in the form of a door or window, comprising:

interposing a mechanical energy storage device between the wing member and a frame member, said energy storage device being operable to move the wing member with discharge of energy, and controlling discharge of energy from the energy storage device as a function of the position of the wing member, said controlling including:

providing an electronically controllable control element, sensing movement of the wing member at multiple positions and providing an electrical output signal representing same, receiving said output signal at a regulating device and operating said regulating device to control the control element as a function of said output signal to thereby change the influence of the control element to change the energy discharge from the energy storage device as a function of the movement of the wing member by storing a motion profile that includes movement velocities assigning an optimized rate of motion for each aperture angle position of the wing member, wherein the energy storage device comprises at least one spring acting against a movable piston disposed in a housing, the piston divides the housing into two housing chambers containing damping fluid, said housing chambers being connected by a fluid line accommodating flow of damping fluid between the housing chambers during movement of the piston, the electronically controllable control element includes an electronically controllable valve in the fluid line, and comparing actual motion of the wing member with the stored motion profile in the regulating device to control said valve as a function of the wing member position signals by clocked switching between an open position of the valve and a closed position of the valve in order to continuously adjust a flow mass of the fluid through the valve, or by continuously adjusting a flow diameter of the valve using a high-speed servo motor with closed loop feedback to achieve the assigned optimized rate of motion, and displaying data and/or entering data via the regulating device.

2. The method according to claim 1, wherein a flow mass through said valve is continuously adjustable.

3. A damping assembly for applying damping forces which resist movements of a wing member acted on by a mechanical energy storage device, said damping assembly comprising:

an electronically controllable control element which is operable to apply a plurality of different levels of damping forces;

a sensor operable to detect positions of the wing member and to produce an electrical output signal, and a regulating device operable to compare actual motion of the wing member with a stored motion profile comprising an optimized rate of motion assigned to each aperture angle position of the wing member and control the control element as a function of the output signal and to thereby apply different levels of damping forces for different positions of the wing member as the wing member is acted on by the energy storage device, wherein the energy storage device comprises at least one spring acting against a movable piston disposed in a housing, wherein the piston divides the housing into two housing chambers containing damping fluid, said housing chambers being connected by a fluid line accommodating flow of damping fluid between the housing chambers during movement of the piston, wherein the electronically controllable control element includes an electronically controllable valve in the fluid line, and wherein the regulating device is operable to continuously control a flow diameter of said valve as a function of the output signal with a servo motor with closed loop feedback to achieve the assigned optimized rate of motion.

4. The damping assembly according to claim 3, wherein said valve is realized as a solenoid operable valve.

5. The damping assembly according to claim 3, wherein said valve is a motor-operable valve.

6. The damping assembly according to claim 3, wherein said valve is realized as a piezo-electrically operable valve.

7. The damping assembly according to claim 3, wherein said regulating device includes a valve cascade comprising plural parallel-configured electrically controllable valves.

8. The damping assembly according to claim 3, wherein said piston is operably connected with an actuator of a wing member driving system.

9. The damping assembly according to claim 3, wherein said wing member is a door and said mechanical energy storage device is operable to act on the door in a door closing direction.

10. The damping assembly according to claim 9, wherein the energy storage device comprises at least one spring acting against a movable piston disposed in a housing.

11. The damping assembly according to claim 10, wherein the piston divides the housing into two housing chambers containing damping fluid, said housing chambers being connected by a fluid line accommodating flow of damping fluid between the housing chambers during movement of the piston, wherein the electronically controllable control element includes an electronically controllable value in the fluid line, and wherein the regulating device is operable to control said valve as a function of the wing member position signature.

12. The damping assembly according to claim 3, wherein said regulating device includes a computer device, a memory device and an electric energy storage device.

13. The damping assembly according to claim 12, wherein said memory device is operable to store operating parameters of the wing member and the energy storage device.

14. The damping assembly according to 13, wherein said computer device is operable to compare the stored operating parameter of the wing member position with the actual electric output signal.

15. The damping assembly according to claim 14, wherein said regulating device is operable to provide an automatic reaction to deviations of the actual operating parameters from the stored operating parameters.

16. The damping assembly according to claim 3, wherein said wing member is pivotably moveable over a range of aperture angles, between an aperture closed position and respective aperture opened positions.

17. The damping assembly according to claim 16, wherein said control element includes a dashpot, and wherein different aperture angles of the wing member are assigned an adjustable and alterable dashpot value.

18. The damping assembly according to claim 17, wherein said regulating device includes an end position function, wherein the dashpot value is reduced or cancelled prior to reaching the closed position of the wing, and wherein the aperture angle of the wing member, at which the end position function activates, can be adjusted and altered.

19. The damping assembly according to claim 16, wherein said control element includes an adjustable opening damper.

20. The damping assembly according to claim 19, wherein an adjustable and alterable opening damper value is assigned to respective different aperture angles of the wing member.

21. The damping assembly according to claim 19, wherein said opening damper is dependent on the opening speed of the wing member.

22. The damping assembly according to claim 19, wherein said opening damper can be switched on and switched off.

23. The damping assembly according to claim 16, wherein said regulating device includes a locking function operable to lock the wing member at a locking angle and wherein the locking angle of the wing member can be adjusted and altered.

24. The damping assembly according to claim 23, wherein the wing member open period can be adjusted and altered.

25. The damping assembly according to claim 23, wherein said locking system can be switched on and switched off.

26. The damping assembly according to claim 3, wherein said sensor is a rotary sensor.

27. The damping assembly according to claim 26, wherein said rotary sensor is a pulse sensor.

28. The damping assembly according to claim 26, wherein said rotary sensor is an absolute value rotary encoder.

29. The damping assembly according to claim 3, wherein said regulating device includes inputs and outputs for connecting external electrical elements.

30. The damping assembly according to claim 3, wherein said regulating device includes an interface for connecting external electrical devices.

31. The damping assembly according to claim 30, wherein said interface is a wire-based interface.

32. The damping assembly according to claim 30, wherein said interface is a wireless interface.

33. The damping assembly according to claim 32, wherein said regulating device can be connected to an external device for data display and/or data entry via the interface.

34. The damping assembly according to claim 32, wherein said regulating device can be diagnosed and/or parameterized via the interface.

35. The damping assembly according to claim 3, wherein said regulating device includes devices for data display and/or data entry.

36. The damping assembly according to claim 3, wherein said regulating device includes a warning sensor device for braking or stopping the movement of the wing member, when an obstruction is present in its movement.

37. The damping assembly according to claim 36, wherein said warning sensor device can be connected to the regulating device.

38. The damping assembly according to claim 36, wherein said warning sensor device is installed in a housing of the damping assembly.

39. The damping assembly according to claim 3, wherein said regulating device has a smoke detector.

40. The damping assembly according to claim 39, wherein said smoke detector can be connected to the control element.

41. The damping assembly according to claim 39, wherein said smoke detector is integrated in a housing of the control element.

42. The damping assembly according to claim 3, wherein a flow mass through said valve is continuously adjustable.

* * * * *